US005598062A

United States Patent [19]

Iigami

[11] Patent Number: 5,598,062

[45] Date of Patent: Jan. 28, 1997

[54] TRANSPARENT PHOTOCATHODE

[75] Inventor: Yoshiki Iigami, Hamamatsu, Japan

[73] Assignee: Hamamatsu Photonics K.K., Hamamatsu, Japan

[21] Appl. No.: 547,990

[22] Filed: Oct. 25, 1995

Related U.S. Application Data

[63] Continuation of Ser. No. 257,146, Jun. 9, 1994, abandoned.

[30] Foreign Application Priority Data

Jun. 22, 1993 [JP] Japan ..... 5-150743

[51] Int. Cl.[6] ..... H01J 40/06

[52] U.S. Cl. ..... 313/542; 313/541

[58] Field of Search ..... 313/541, 542, 313/527, 530; 252/514; 445/51

[56] References Cited

U.S. PATENT DOCUMENTS

| | | | |
|---|---|---|---|
| 3,809,941 | 5/1974 | Bourg, Jr. et al. | 313/94 |
| 3,992,071 | 11/1976 | Hughes et al. | 316/18 |
| 4,396,853 | 8/1983 | Caraher | 313/527 |
| 4,725,758 | 2/1988 | Iigami | 313/542 |
| 4,816,183 | 3/1989 | Bates, Jr. | 252/514 |
| 4,853,595 | 8/1989 | Alfano et al. | 313/542 |
| 4,950,952 | 8/1990 | Aramaki | 313/542 |
| 5,118,952 | 6/1992 | Sakamoto et al. | 313/542 |

FOREIGN PATENT DOCUMENTS

| | | | |
|---|---|---|---|
| 59-184444 | 10/1984 | Japan | H01J 40/06 |
| 357572 | 3/1991 | Japan | B23K 13/00 |

OTHER PUBLICATIONS

Jin–Lei et al, "Experimental Study on Photoemissive Thin Film's With Ultrafine Particles", CHINESE SCIENCE BULLETIN, vol. 38, No. 15, Aug. 1993, pp. 1262–1264.

*Primary Examiner*—Michael Horabik
*Assistant Examiner*—Michael Day
*Attorney, Agent, or Firm*—Cushman Darby & Cushman, IP Group of Pillsbury Madison & Sutro, LLP

[57] ABSTRACT

A transparent photocathode comprises a silver layer formed on a transparent substrate, comprising silver particles having an average diameter of 80 to 200 nm, and a silver oxide layer, potassium layer, and a cesium layer. As a result of the silver layer comprising silver particles having dispersive diameters, the transparent photocathode can selectively achieve high sensitivity to an infrared region of near 1.5 μm wavelength.

4 Claims, 3 Drawing Sheets

TRANSPARENT PHOTOCATHODE

This is a continuation of application Ser. No. 08/257,146, filed on Jun. 9, 1994, which was abandoned upon the filing hereof.

BACKGROUND OF THE INVENTION

1. Field of the Invention

The present invention relates to a transparent photocathode and a photoelectric tube utilizing the transparent photocathode.

2. Related Background Art

As a transparent photocathode having high sensitivity to an infrared region, the transparent photocathode disclosed in "Japanese Patent Publication No. 3-57572 (57572/1991)" has been known. In this transparent photocathode, a silver layer, a silver oxide layer, a potassium layer, a silver layer, a cesium layer, and a silver layer are deposited on a glass substrate in order. Further, in this publication, a transparent photocathode in which a silver layer, a silver oxide layer, a potassium layer, a cesium layer, and a silver layer are deposited on a glass substrate is also disclosed. In the conventional techniques including the techniques disclosed in the aforementioned publication, the diameter of the silver particles forming a silver layer on a transparent substrate is within the range of 50 to 70 nm for all particles. A particle diameter in the silver layer of the conventional products is obtained with use of SEMS (scanning electron microscopes).

However, in the aforementioned transparent photocathodes, the former has the sensitivity up to about 1.4–1.6 μm wavelength, whereas the latter has the sensitivity up to about 1.2 μm wavelength, but both do not have the sensitivity to the long wavelength region and their quantum efficiencies are insufficient. Further, the former has the sensitivity to near 1.5 μm wavelength but also has the high sensitivity to near infrared or visible light the wavelength of which is shorter. Because of this, if the former is applied to, e.g., a light communication system, disturbance noise is produced.

SUMMARY OF THE INVENTION

The present invention solves the above problems associated with the conventional techniques, and achieves such objects by looking at the silver layer constituents from a viewpoint of a particle diameter.

A transparent photocathode according to the present invention comprises a silver layer formed on a transparent substrate including silver particles having an average diameter of 80 to 200 nm (more preferably 80 to 150 nm), and silver oxide and an alkaline layer which are formed on the silver layer. Further, the present invention provides a photoelectric tube using the transparent photocathode.

According to the present invention, the silver layer is formed on a glass substrate, and the silver oxide layer, the potassium layer, and the cesium layer are formed on the silver layer, with the silver layer including silver particles. Conventionally, a diameter of the particle is within the range of 50 to 70 nm for all particles. In the present invention however, the silver layer comprises not only those particles sized as in conventional structures, but also particles having a larger diameter of 80 to 200 nm. As a result of the silver layer comprising particles having dispersive diameters, while the high sensitivity to an infrared region of 1.5 μm wavelength band is achieved, for the visible region and near infrared region, the sensitivity may be suppressed.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DETAILED DESCRIPTION OF THE PREFERRED EMBODIMENTS

The embodiments of the present invention will be described below with reference to the accompanying drawings.

Figure 1:
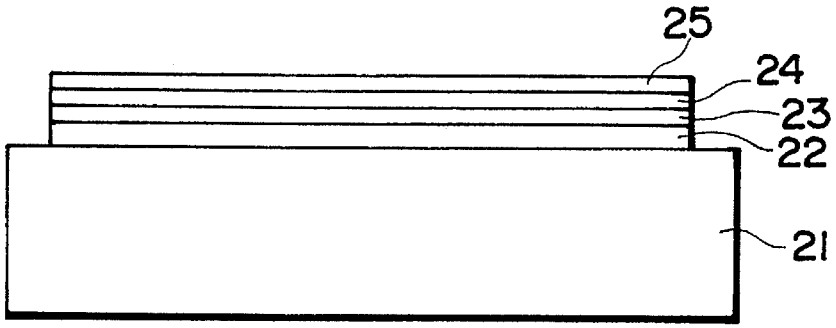
FIG. 1 is a sectional view of a transparent photocathode according to one embodiment of the present invention.

FIG. 1 shows a cross section of a transparent photocathode of an embodiment of the present invention. As shown in FIG. 1, a silver layer 22 comprising silver particles having a diameter of 60 to 150 nm in which at least particles having a diameter of 80 to 150 nm are included in some part, a silver oxide layer 23, a potassium layer 24, and a cesium layer 25 are deposited on a glass substrate 21 in that order. In such a transparent photocathode, when light enters from the glass substrate 21, photoelectrons are generated and emitted from the cesium layer 25 to vacuum. The photoelectric tube 1 comprises a cylindrical airtight container 2 with a base which is made of glass. Then, a light-receiving surface region of the airtight container 2 constitutes the glass substrate 21 of FIG. 1.

A photocathode 4 is formed on an internal wall of a first base 3 of the airtight container 2. A plane anode 5 is placed to face the photocathode 4, and a thin layer 6 of chrome is formed on an internal surface of side wall of the airtight container 2 extending from the first base (hereinafter called faceplate) 3 to the anode 5. The chrome layer 6 is a conductor to provide a current to the photocathode 4 and functions to prevent light other than the incident light from passing through the faceplate 3. Silver particles fixed to a tungsten wire are attached on a surface of the anode 5 opposing the photocathode 4. One end of the nichrome wire with the attached silver particles 7 is connected to a lead-in wire 12 and the other end is connected to the anode 5.

A potassium container 9 and a cesium container 10 are placed between a second base (hereinafter called stem) 8 and the anode 5. Lead wires 11, 12, 13, 14, 15, 16 and 17 are bedded in the stem 8 in circle, and an exhaust tube 18 is placed at the center of the lead wires. The photocathode 4 is electrically connected to the lead-in wire 11 through the chrome layer 6. The anode 5 is electrically connected to the lead-in wire 17. The potassium container 9 which is the cylinder of tantalum foil contains potassium chromate, zirconium, and tungsten. One end of the potassium container 9 is connected to the lead-in wire 13 and the other end is connected to the lead-in wire 14. The cesium container 10 which is the cylinder of tantalum foil contains cesium chromate, zirconium, and tungsten. One end of the cesium container 10 is connected to the lead-in wire 15 and the other end is connected to the lead-in wire 16.

Next, the process of forming the photocathode of the embodiment will be explained with reference to FIG. 2 and FIG. 3. Here, the photosensitivity of the photocathode 4 during the process of forming the photocathode 4 is obtained by detecting a current flowing from the lead-in wire 17 under application of the voltage of 50 to 150 V between the photocathode 4 and the anode 5. FIG. 3 is a graph showing the sensitivity of the photocathode in the manufacturing process and changes of the tube temperature.

Figure 2:
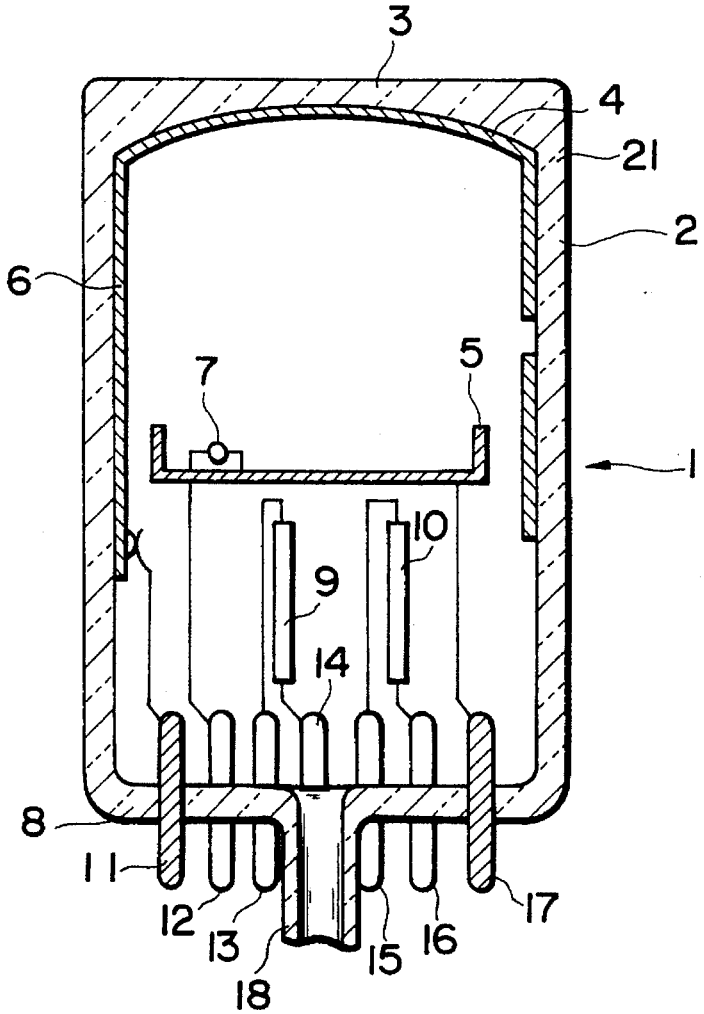
FIG. 2 is a sectional view of a photoelectric tube using the transparent photocathode of FIG. 1 in the manufacturing process.
Figure 3:
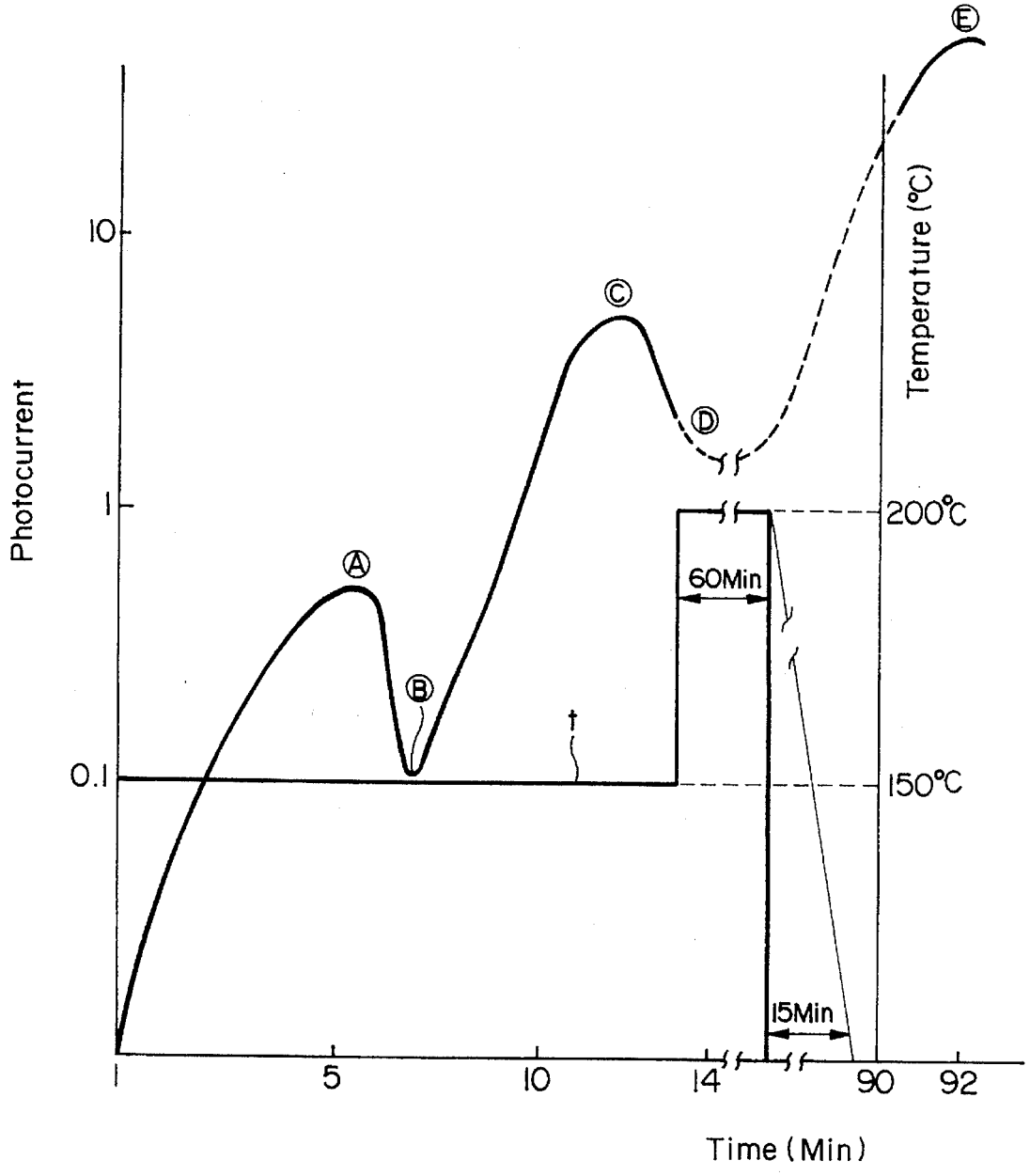
FIG. 3 is a graph showing a manufacturing method according to one embodiment of the present invention.

First, the airtight container 2 is evacuated through the exhaust tube 18 shown in FIG. 2, and its inside is kept at $10^{-6}$ Tort. Next, the photoelectric tube 1 is heated to high temperature to clean the inside of the photoelectric tube 1. For example, the temperature is 450° C. and time is approximately one hour. Next, after cooling down the photoelectric tube 1 to room temperature, in order to control the silver particle diameter (not to make the particles uniform in size but to mix the particles having different size), oxygen at a pressure of $1\times10^{-4}$ Tort or higher is introduced into the photoelectric tube 1. Next, silver is vapor-deposited from the silver piece 7 to the internal wall of the faceplate 3. This vapor deposition continues until the thin film turns gray, whereby the thin silver film which comprises silver particles at least including silver particles having a diameter of 80 to 150 nm in some part is formed. Next, pure oxygen is introduced into the tube 1, and oxygen gas is discharged in a high frequency electric field to oxidize the surface of the thin silver film. At this time, the pressure of oxygen gas is approximately 1 Torr. To generate the high frequency electric field, one output of a high frequency voltage generator, not shown, is connected to the anode 5 and the other output is connected to an electrode which is placed close to the outer wall of the faceplate 3. Thereafter, oxygen is exhausted from the photoelectric tube 1. Next, the photoelectric tube 1 is heated to 150° C. This temperature may be within the range of 70° C. to 200° C. Then, the sensitivity of the photocathode is measured while the substrate and the silver layer are being heated to 70° C. to 200° C., and at the same time, the potassium container 10 is heated by flowing currents to emit potassium, whereby potassium adsorption on the silver layer is started. As shown in FIG. 3, the potassium emission is continued after the sensitivity of the photocathode reaches the maximum (point A), and at the point (point B) where the sensitivity is about half of the maximum sensitivity of the photocathode, the potassium emission is terminated and the process of forming the potassium layer is completed. Next, while the sensitivity of the photocathode is being measured, cesium is emitted from the cesium container 10 to adsorb. As shown in FIG. 3, after the sensitivity of the photocathode reaches the maximum (point C), the cesium emission for adsorbing is continued, and at the point (point D) where the photosensitive of the photocathode reaches about half of the maximum, the cesium deposition is terminated and the process of forming the cesium layer is completed. Next, the photoelectric tube 1 is heated at 200° C. for 60 minutes. This temperature may be within the range of 170° C. to 220° C. While heating, the photoelectric sensitivity is difficult to be measured because of increase of dark current. Then, the tube i is cooled down to room temperature in 15 minutes. Thereafter, the photoelectric tube is sealed and cut from the exhaust device. As described above, the transparent photocathode formed on the transparent substrate, that is, the photocathode, which comprises the silver layer at least including the silver particles having a diameter of 80 to 150 nm in some part, the silver oxide layer formed on the surface of the silver layer, the potassium layer formed on the silver oxide layer, and the cesium layer formed on the potassium layer, is formed. The diameter of the silver particle was observed by a SEM (Scanning Electron Microscope). This matter will be explained in detail. The diameter of the silver particle forming the conventional photocathode was uniform in size within the range of 50 to 70 nm, and no huge particle was found. However, according to the photocathode of the present invention, it was found that the photocathode 4 comprised not only the particles having the same diameter as conventional photocathodes also particles having a larger diameter, specifically within the range of 80–150 nm. In other words, in the present invention, the size of the particle is of various kinds and the various size of the particles are mixed. That is, particles having a diameter of 60–80 nm, particles having a diameter of 80–100 nm, and particles having a diameter of 100–150 nm are included together to form the photocathode. It can be considered that the achievement of the remarkable improvement of the wavelength sensitivity in the present invention is because the particles which are different in size are included and in particular, the particles having the diameter of 80–150 nm are included in part of the silver layer.

Figure 4:
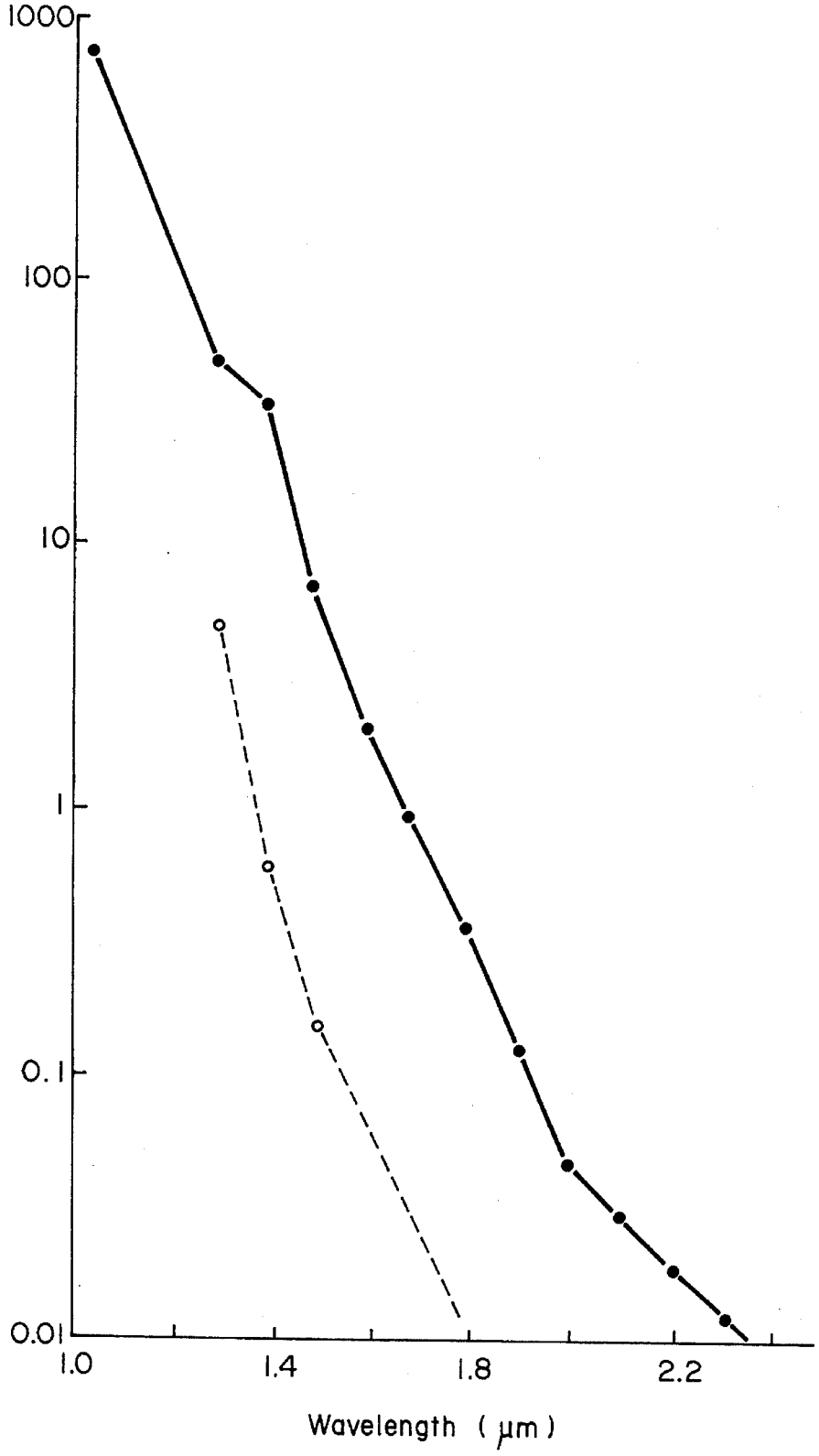
FIG. 4 is a graph comparing photosensitivity of a transparent photocathode of one embodiment with a conventional photocathode.

Spectral characteristics of the photocathode of the embodiment manufactured in the above process is shown in FIG. 4 with comparing the conventional photocathode in which the particle diameter in the silver layer is uniform within the range of 50–70 nm. In the infrared region of comparatively long wavelength of 1.3–1.8 μm, the sensitivity is remarkably improved. Further, the sensitivity of the conventional photocathode to white light is 20–30 μA/lm or 40–45 82 A/lm, and the near infrared sensitivity, which is measured through an IRDI filter which transmits light having an 8000 Å wavelength is 4–5 μA/lm or 7–8 μA/lm. On the other hand, the sensitivity of the photocathode manufactured in the above process to white light is suppressed in low, 10–20 μA/lm, and the near infrared sensitivity is lowered to 1.5–2.0 μA/lm.

Thus, the photocathode according to the present invention has the excellent effect that while the sensitivity to near 1.5 μm wavelength which is widely used in optical communication is enhanced, the sensitivity to the near infrared region and the visible region is rarely enhanced. Therefore, the photocathode can be applied to a photoelectric tube for the infrared detection, or a photomultiplier tube having a secondary electron multiplier unit such as a dynode or a microchannel plate.

According to a photocathode of the present invention, a silver layer comprising silver particles having a diameter within the range of 60–150 nm at least including particles having a diameter of 80–150 nm in some part is formed, and a silver oxide layer, a potassium layer, and a cesium layer are formed on the silver layer, whereby in the infrared region near 1.5 μm wavelength, the high sensitivity is selectively achieved. Accordingly, the photocathode can widely be applied to the verification of the light communication system.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

What is claimed is:

1. A transparent photocathode having a high sensitivity to light with a wavelength between 1.3 μm and 1.8 μm used in optical communication, comprising:

a transparent substrate;

a silver layer formed on said transparent substrate and having an oxidized surface thereof, said silver layer consisting essentially of silver particles, said silver particles including at least silver particles having a diameter greater than 100 nm; and an alkaline layer comprising a potassium layer consisting essentially of potassium and a cesium layer consisting essentially of cesium, said alkaline layer formed on said oxidized surface of said silver layer.

2. A photoelectric tube having a high sensitivity to light with a wavelength between 1.3 μm and 1.8 μm used in optical communication, comprising:

a transparent photocathode provided in a vacuum container, said transparent photocathode comprising:

a silver layer formed on a transparent substrate and having an oxidized surface thereof, said silver layer consisting essentially of silver particles, said silver particles including at least silver particles having a diameter greater than 100 nm; and an alkaline layer comprising a potassium layer consisting essentially of potassium and a cesium layer consisting essentially of cesium, said alkaline layer formed on said oxidized surface of said silver layer; and an anode for receiving electrons emitted from said transparent photocathode, said anode being provided in said vacuum container.

3. A photocathode having a high sensitivity to light with a wavelength between 1.3 μm and 1.8 μm used in optical communication, comprising:

a substrate:

a silver layer formed on said substrate and having an oxidized surface thereof, said silver layer consisting essentially of silver particles, said silver particles including at least silver particles having a diameter greater than 100 nm; and an alkaline layer formed either on or above said oxidized surface of said silver layer;

wherein said alkaline layer comprises a potassium layer consisting essentially of potassium and a cesium layer consisting essentially of cesium, said cesium layer being in direct contact with said potassium layer.

4. A photoelectric tube, comprising:

a photocathode provided in a vacuum container having a high sensitivity to light with a wavelength between 1.3 μm and 1.8 μm used in optical communication, comprising:

a silver layer formed on an inner surface of said container and having an oxidized surface thereof, said silver layer consisting essentially of silver particles, said silver particles including at least silver particles having a diameter greater than 100 nm; and an alkaline layer formed either on or above said oxidized surface of said silver layer; and an anode for receiving electrons emitted from said photocathode, said anode being provided in said vacuum container;

wherein said alkaline layer comprises a potassium layer consisting essentially of potassium and a cesium layer consisting essentially of cesium, said cesium layer being in direct contact with said potassium layer.

* * * * *